United States Patent [19]

Tuzzolino

[11] 4,399,581

[45] Aug. 23, 1983

[54] PLASTER SURFACE FINISHING DEVICE

[76] Inventor: Carmen J. Tuzzolino, 37009 Gary, Sterling Heights, Mich. 48077

[21] Appl. No.: 189,809

[22] Filed: Sep. 22, 1980

Related U.S. Application Data

[62] Division of Ser. No. 76,365, Sep. 17, 1979, Pat. No. 4,258,898.

[51] Int. Cl.[3] ..... B25G 1/00; A46B 17/00

[52] U.S. Cl. ..... 15/176; 15/145

[58] Field of Search ..... 15/145, 166, 202, 176, 15/210.5; 7/158, 167; 16/124, DIG. 24, DIG. 25, 110 A, 110 R, 114 A, 114 R; 30/332, 337, 339

[56] References Cited

U.S. PATENT DOCUMENTS

| | | | |
|---|---|---|---|
| 56,025 | 7/1866 | Figer | 15/176 |
| 1,526,112 | 2/1925 | Blackaller et al. | 425/376 R |
| 1,828,738 | 10/1931 | Hood | 425/87 |
| 1,829,479 | 10/1931 | Elkins | 425/87 |
| 2,420,062 | 5/1947 | Ames | 425/87 |
| 2,610,354 | 9/1952 | Howell | 30/332 |
| 2,630,703 | 3/1953 | Sommers | 425/87 |
| 2,720,176 | 10/1955 | Babbitt . | |
| 3,087,654 | 4/1963 | Moore | 401/9 |
| 3,790,331 | 2/1974 | Backer | 425/464 |

FOREIGN PATENT DOCUMENTS

| | | | |
|---|---|---|---|
| 585946 | 10/1933 | Fed. Rep. of Germany | 15/166 |
| 1005844 | 4/1952 | France . | |
| 465937 | 10/1951 | Italy | 30/339 |
| 274577 | 6/1949 | Switzerland | 30/339 |

*Primary Examiner*—Willard E. Hoag

*Attorney, Agent, or Firm*—Basile, Weintraub & Hanlon

[57] ABSTRACT

A device for finishing a wet plaster surface is disclosed. The device of the present invention comprises a finishing tool holder which includes a handle engaging lower end. An upper end of the holder broadens to a planar fan shape, and the upper end is notched to create a step. A filler piece complementary to and substantially filling the notch is inserted therein. A threaded fastener proximate a lower end of the notch secures a lower end of the filler piece to the handle. A pair of spaced apertures near the upper end of the holder are aligned with a pair of spaced apertures in the filler piece, and a pair of threaded fasteners engage the aligned apertures to secure a variety of surface finishing tools to the holder. The surface finishing tools which are directly attachable to the handle include an elongated brush, a variety of trowels with various widths and edge forms, and a circular or star-shaped cup. Each of the above tools is attached to the handle by a flange insertable between the handle and the filler piece with a pair of spaced apertures aligned with the apertures formed in the handle to accommodate a pair of threaded fasteners which secure the tool to the handle.

1 Claim, 6 Drawing Figures

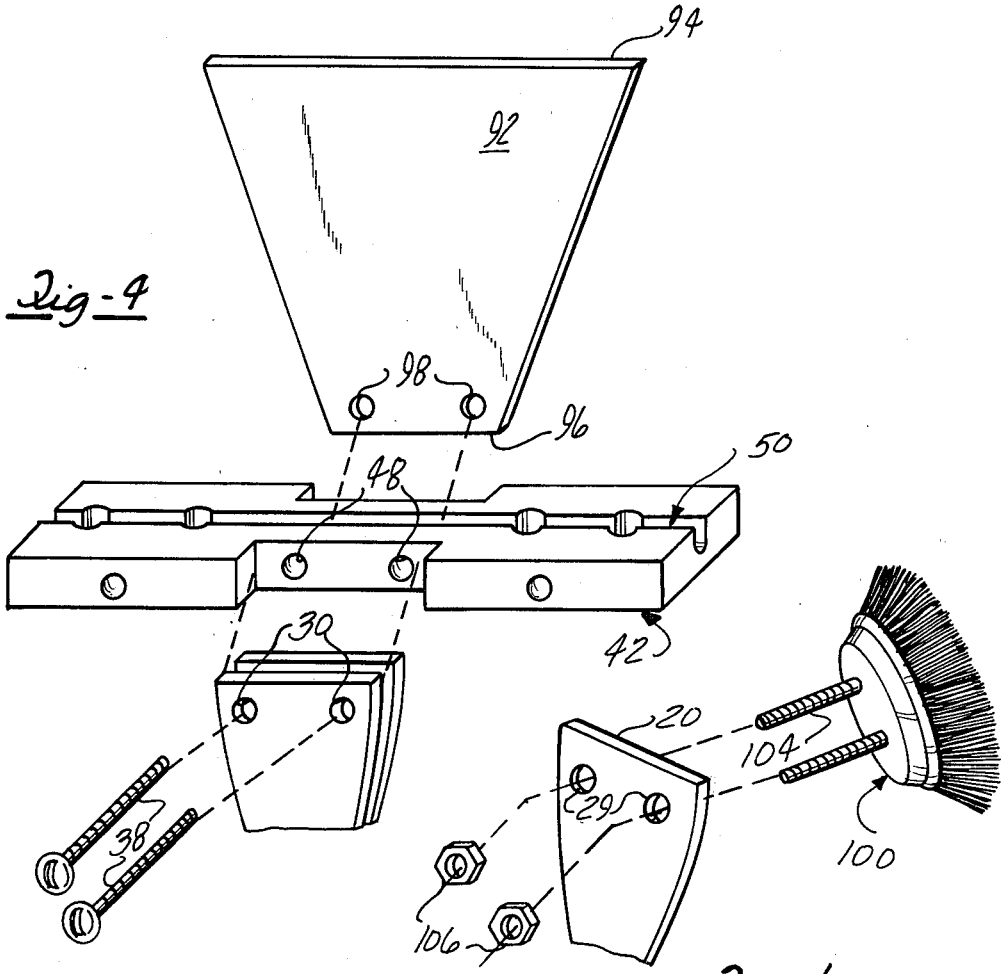
Fig-4
Fig-6
Fig-5
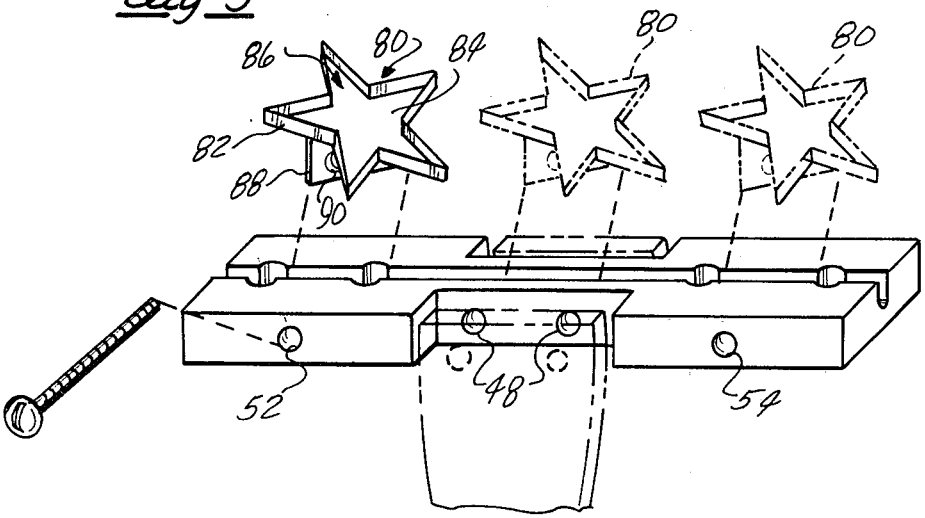

PLASTER SURFACE FINISHING DEVICE

This application is a division of application Ser. No. 076,365, filed Sept. 17, 1979 U.S. Pat. No. 4,258,898.

BACKGROUND OF THE INVENTION

I. Field of the Invention

The present invention relates to the field of plastering devices. More particularly the present invention relates to the field of hand held plastering devices, even more particularly the present invention relates to the field of hand held plastering devices for finishing wet plaster surfaces, producing various surface effects.

II. Prior Art Statement

Devices for finishing plaster surfaces and for applying or forming various designs in wet surfaces have long been known.

U.S. Pat. No. 1,526,112 discloses a machine for making flowered designs of sugar. The disclosed device forms a flower by extruding liquid frosting through a formed orifice.

U.S. Pat. No. 1,828,738 discloses a mortar spreader which is mounted to a handle. The handle is hollow and accommodates a mortar mixture which is pumped through the handle. The device is used for spreading mortar or plastic along a wall or ceiling.

U.S. Pat. No. 1,829,479 discloses a plastering machine which forces plaster along a hollow handle of the device and allows the plaster to be distributed along a wall or ceiling.

U.S. Pat. No. 2,630,703 discloses a hand held plastic applicator.

U.S. Pat. No. 2,420,062 discloses a corner finishing tool which is deployed at the end of a hand held handle.

U.S. Pat. No. 3,087,654 discloses a crack filling dispenser which has a head of varying shape for filling corners and/or flat surfaces.

U.S. Pat. No. 3,790,331 discloses a plastering device for forming flowers by extruding plaster through a variety of shaped orifices.

None of the above listed U.S. patents disclose the present invention of a tool holder selectively attached to the end of an elongated handle. The tool holder of the present invention is adapted to hold a variety of plaster shaping and forming devices for creating a variety of surface effects in soft plaster deployed on walls and ceilings.

SUMMARY OF THE INVENTION

The present invention comprises a device for finishing a wet plaster surface which includes a finishing tool holder releasably attachable to a handle which allows the user to comfortably reach ceilings. A lower end of the tool holder includes a handle engaging means and the tool holder broadens at an upper portion into a planar fan shape. An upper portion of the tool holder including the planar fan shape is notched to create a step. A filler piece complementary to and substantially filling the notch fills the step. A threaded insert is anchored in the holder proximate a lower end of the notch, and an aperture is formed in the filler piece aligned with the threaded insert to accommodate a threaded fastener which slidingly engages the aperture to loosely attach the filler piece to the holder at the lower end of the filler piece.

A first pair of spaced apertures are formed through the holder at the upper portion thereof and a second pair of apertures are formed through the filler aligned with the first pair of apertures. The apertures are employed to secure a variety of surface finishing tools which will be described more fully hereinbelow.

An elongated brush including a handle portion is snugly retainable between the notch and the filler piece. A pair of apertures formed in the handle are aligned with the apertures in the tool holder and the filler piece. A pair of threaded fasteners slidingly engage the aligned apertures and a pair of nuts engage the threaded fastener to secure the brush to the holder. The elongated brush is utilized to produce a brushed surface effect in wet plaster, or a swirl effect may be produced by rotating the brush as it meets the wet plaster.

A circular cup may be employed to produce a variety of circular depressions in a wet plaster surface. The circular cup includes a vertical circular portion, a flat bottom, and an open top. A downward extending flange is affixed to the bottom of the cup, the flange configured to slidingly engage a space between the handle and the filler piece. A pair of spaced apertures formed in the flange align with the apertures in the handle and the filler piece to accommodate the pair of threaded fasteners and secure the cup to the handle. Alternately the cup may be secured by its flange to a groove formed in a cross bar which is attachable to the handle as will be described more fully hereinbelow.

The tool holder may also selectively support a variety of trowels which have a variety of upper edge configurations to produce different surface effects in wet plaster. The trowels include the upper edge and a lower edge and include a thickness to be slidingly engaged by the tool holder between the tool holder upper portion and the filler piece. A pair of spaced apertures formed in the trowel near the lower edge are aligned with the apertures in the filler piece and the tool holder to slidingly receive the pair of threaded fasteners to secure the trowel to the tool holder.

To produce other surface effects a cross bar is employed which is snugly retained between the notch and the filler piece. A pair of recesses are formed in the cross bar to receive the upper end of the holder and the filler piece. A pair of spaced apertures are formed in the recess aligned with the pair of apertures in the handle and the filler piece and the pair of threaded fasteners are employed to slidingly engage the aligned apertures and secure the cross bar to the tool holder. A groove is formed along an upper wall of the cross bar with the groove extending vertically below the pair of apertures.

Two pairs of vertical spaced apertures parallel and central to the groove are formed in the cross piece spaced in from the ends thereof. A pair of circular brushes including a handle portion have a pair of threaded studs projecting downward therefrom, the studs are aligned with the pairs of vertical spaced apertures. The studs of each circular brush slidingly engage the vertical apertures, and a plurality of nuts threadingly engage the studs to secure the circular brushes to the cross bar. The spaced circular brushes may be employed to produce a variety of surface effects in wet plaster including double swirls and circular stippled surfaces. The groove of the cross bar is configured to receive a variety of tools including the trowels, and the flange of the cup. Cup shaped devices with an open top of varying shape such as a star shape, square shape, etc. which have flanges adapted to be received by the groove may be deployed along the cross bar to produce a variety of surface effects.

For a more complete understanding of the present invention, reference is made to the following detailed description and accompanying drawings.

Other objects, advantages, and applications of the present invention will become apparent to those skilled in the field to which this invention pertains, when the accompanying description of the best modes contemplated for practicing the invention are read in conjunction with the accompanying drawings.

BRIEF DESCRIPTION OF THE DRAWINGS

In the drawings, like reference numbers refer to like parts throughout the several views, and wherein:

FIG. 4 illustrates the tool holder and cross bar of the present invention releasably supporting a trowel;

FIG. 5 illustrates a broken perspective view of the tool holder and cross bar of the present invention releasably supporting a plurality of star shaped cups; and FIG. 6 illustrates a broken perspective view of the tool holder releasably supporting a brush of FIG. 3.

DESCRIPTION OF THE PREFERRED EMBODIMENT

Figure 1:
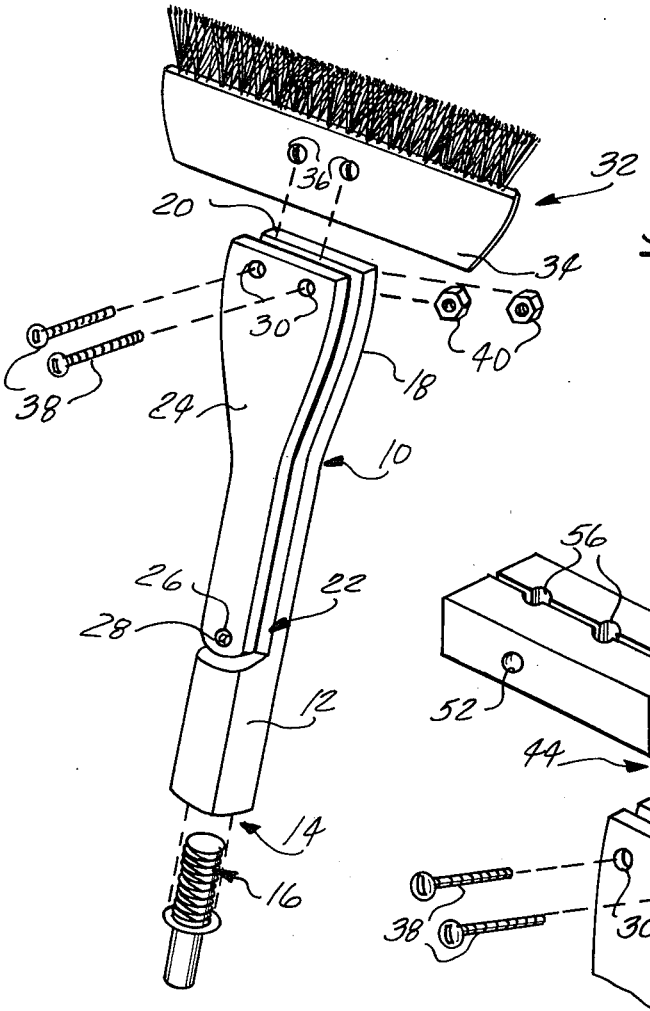
FIG. 1 illustrates a perspective view of the tool holder of the present invention releasably supporting an elongated brush.

Referring now to the drawings and in particular to FIG. 1 wherein there is illustrated at 10 a finishing tool holder of the present invention. The finishing tool holder comprises a lower end 12 including a handle engaging means 14 comprising a threaded aperture configured to threadingly engage a threaded insert 16 which has an end configured to releasably engage a handle for extending the finishing tool holder 10 to hard to reach places such as the top walls and ceilings.

The lower end 12 is configured to be readily grasped by the hand of the user and extends upward broadening to a planar fan shape 18 at an upper portion 20 where the tool holder terminates. The upper portion of the tool holder including the planar fan is notched creating a step terminating above the lower end 12. A filler piece 24 is inserted into the notch, the filler piece is complementary to and substantially fills the notch 22. A threaded insert (not shown) is inserted into the holder proximate a lower end of the notch. An aperture 26 is formed in the filler piece aligned with the threaded insert, and a threaded fastener 28 engages the threaded insert and loosely affixes the filler piece 24 to the finishing tool holder 10. A first pair of spaced apertures 29 (not shown) are formed through the holder at the upper portion, and a second pair of apertures 30 are formed in the filler piece 24 aligned with the pair of spaced apertures in the tool holder.

An elongated brush 32 including a handle portion 34 is insertable between the tool holder and the filler piece 24. A third pair of apertures 36 are formed in the handle portion 34 aligned with the apertures 30 and a pair of threaded fasteners 38 pass through the aligned apertures and a pair of nuts 40 threadingly engage the fasteners 38 to secure the elongated brush to the tool holder 10. The elongated brush 32 together with the tool holder 10 may be employed to create a brushed finish in wet plaster or the elongated brush may be employed to produce a surface finish comprising a plurality of swirls by rotating the handle as it contacts the surface.

Figure 2:
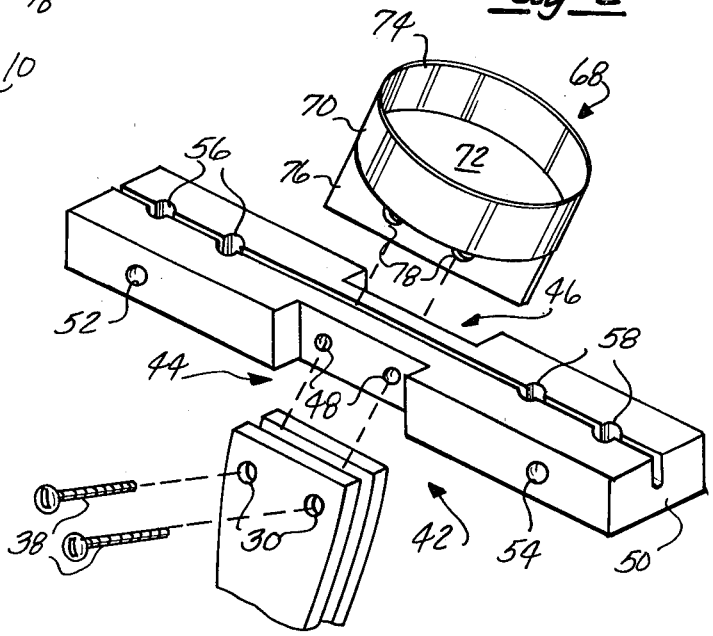
FIG. 2 illustrates a broken perspective view of the handle of the present invention releasably supporting a cross bar and a circular cup.

Referring now to FIG. 2 of the drawings wherein there is illustrated a cross bar 42 releasably attachable to the finishing tool holder 10. The cross bar 42 includes a pair of recesses 44,46 formed in the cross bar at a center thereof to receive the upper portion of the holder and the filler piece. A fourth pair of apertures 48 are formed in the recess 44 aligned with the first and second pairs of apertures. The cross bar 42 is inserted between the holder 10 and the filler piece 24 and secured by the pair of threaded fasteners 38 passing through the aligned holes and the pair of nuts 40 threadingly engaging the threaded fasteners 38. A groove 50 is formed along an upper wall of the cross bar extending along the length thereof, the groove extending vertically below the third pair of apertures. A fourth pair of spaced apertures 52,54 in line with the apertures 48 extend across the groove and through the cross bar proximate the ends of the cross bar. Two pairs of vertical spaced apertures 56,58 parallel to and central to the groove 50 are formed in the cross piece 42 spaced in from the ends thereof. The purpose of the spaced apertures 56,58 will be detailed more fully hereinbelow.

Still referring to FIG. 2 of the drawings wherein there is illustrated a circular cup 68 which is mountable to the cross bar 42. The circular cup 68 includes a vertical circular portion 70 which comprise the sides of cup and a flat bottom 72 and an open top 74. A first flange 76 is affixed to the bottom 72 and extends vertically downward to snugly engage the groove 50. A fifth plurality of spaced apertures 78 are formed in the flange 76 aligned with the apertures 48. To fasten the cup 68 to the cross piece 42 the flange 76 is inserted into the groove 50 and the pair of threaded fasteners 38 are passed through the aligned apertures with the pair of nuts 40 threadingly engaging the threaded fasteners to secure the cup 68 to the cross bar. Alternately, the cup 68 may be attached directly to the finishing tool holder 10 by inserting the flange 76 between the tool holder 10 and the filler piece 24 and aligning the aperture 78 with the apertures 30 and inserting the threaded fasteners 38 through the aligned apertures and threadingly securing the nuts 40 to the ends of the threaded apertures 38. The circular cup 68 may be employed to form circular impressions in wet plaster. It is obvious to the skilled artisan that a plurality of cups 68 may be affixed to the cross bar 42 to form a plurality of recesses in soft plaster simultaneously.

Referring again to the drawings and in particular to FIG. 5 wherein there is illustrated a plurality of star shaped cups 80 which are releasably mountable to the cross bar 42. The star shaped cups 80 comprise vertical side walls 82 integral with a flat bottom 84 and an open top 86. A second flange 88 is fixedly attached to the bottom 84 and extends vertically downward therefrom. The second flange 88 is configured to be slidingly inserted into the groove 50. A pair of apertures 90 formed in the flange 88 are configured to selectively align with the apertures 52 or 54 or the pair of apertures 48 where the threaded fasteners 38 and the nuts 40 may be employed to secure the cup shaped stars 80 to the cross bar 42. The cup shaped stars are employed to form a plurality of star shaped recesses in wet plaster.

Referring now to FIG. 4 of the drawings wherein there is illustrated a trowel 92 for finishing wet plaster surfaces which is releasably insertable into the groove 50 of the cross piece 42. The trowel 92 comprises an upper edge 94 tapering down to a lower edge 96. The thickness of the trowel at the lower edge 96 is configured to be slidingly engageable with the groove 50 of the cross piece 42. A sixth pair of spaced apertures 98 are aligned with the apertures 48 and 30, and the threaded fasteners 38 are insertable into the aligned apertures and the nuts 40 secure the trowel to the cross piece and the finishing tool holder. Alternately the trowel 92 may be inserted directly into the space between the tool holder 10 and the center piece 24 and the apertures 30 and 98 aligned with the threaded fasteners 38 passing through the aligned apertures and the nuts 40 threadingly engaging the fasteners 38 to secure the trowel to the finishing tool holder. The trowel 92 may have an upper edge 94 of varying length to accommodate varying finishing requirements. The upper edge 94 may also be curved or have other non linear configurations to accommodate varying surface finish requirements.

Figure 3:
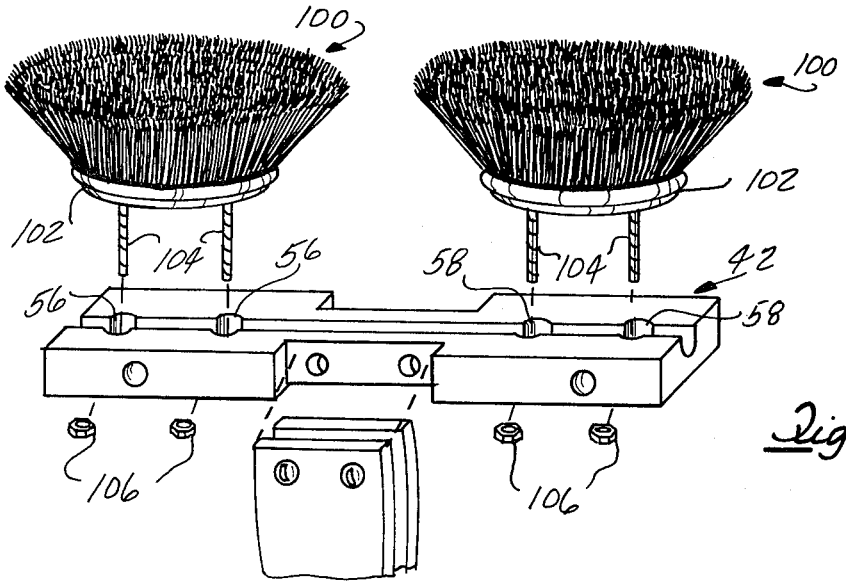
FIG. 3 illustrates a broken perspective view of the tool holder and cross bar of the present invention releasably supporting a bar of circular brushes.

Referring now to the drawings and in particular to FIG. 3 wherein there is illustrated a pair of circular brushes 100 which are releasably attachable to the cross bar 42. The circular brushes 100 include a handle portion 102 which supports the bristles of the brush. A pair of threaded studs 104 are fixedly attached to each of the handle portions, the studs 104 aligned with the vertical spaced apertures 56,58. The apertures 56,58 are configured to slidingly receive the threaded portion of the threaded studs 104, and the circular brushes 100 are releasably attached to the cross member 42 by inserting the studs 104 into the spaced apertures 56,58 and threadingly engaging the threaded studs with a plurality of nuts 106 to releasably secure the brushes 100 to the cross piece 42. The pair of circular brushes 100 affixed to the cross piece are employed to produce a circular stippled effect in wet plaster or to produce an over lapping swirl effect by contacting the brushes to the wet plaster and rotating the handle simultaneously.

FIG. 6 of the drawing illustrates one of the brushes 100 releasably attached to the upper portion 20 employing the first pair of spaced apertures 29 which receive the pair of threaded studs 104. A pair of the nuts 106 threadingly engage the studs 104 to secure the brush to the upper portion for stippling walls.

There has been described hereinabove a device for producing various surface finishes in wet plaster. A variety of tools for producing a plurality of designs and surfaces are readily interchangeable and releasably insertable into the handle of the device.

Having thus described my invention what I claim is:

1. A device for finishing a wet plaster surface comprising:

a finishing tool holder comprising a lower end including a handle engaging means; the holder broadening to a planar fan shape at an upper end thereof; an upper portion of the holder including the planar fan notched creating a step; a filler piece complementary to and substantially filling the notch; a threaded insert in the holder proximate a lower end of the notch; an aperture formed in the filler piece aligned with the threaded insert; a threaded fastener slidingly engaging the aperture in the filler piece and threadingly engaging the threaded insert to loosely attach the filler piece to the holder; and a first pair of spaced apertures formed through the holder at the upper portion thereof, and a second pair of apertures formed through the filler aligned with the first pair of apertures;

a cross bar snugly retained between the holder and the filler piece;

a pair of recesses formed in the cross bar to receive the upper end of the holder and the filler piece;

a fourth pair of spaced aperture formed in the recess aligned with the first and second pairs of apertures;

a pair of threaded fasteners slidingly engaging the aligned apertures, and a pair of nuts engaging the threaded fasteners to secure the cross bar to the holder;

a groove formed along an upper wall of the cross bar extending vertically below the third pair of apertures;

a fourth pair of spaced apertures formed through the cross bar parallel to the third apertures proximate the ends of the cross bar and crossing the groove; and two pairs of vertical spaced apertures parallel and central to the grove formed in the cross piece spaced in from the ends thereof;

a pair of circular brushes including a handle portion;

a pair of threaded studs aligned with the two pairs of vertical spaced aperture, each pair of studs affixed to each handle portion, the studs slidingly engaging the vertical apertures, and a plurality of nuts threadingly engaging the studs to secure the circular brushes to the cross bar; and whereby the circular brushes can be employed to produce a circular stippled surface in the plaster.

* * * * *